US012187486B2

(12) United States Patent
Poran

(10) Patent No.: US 12,187,486 B2
(45) Date of Patent: Jan. 7, 2025

(54) SYSTEMS METHODS AND RESPECTIVE KIT-OF-PARTS FOR ELEVATING POLYMERIC CRATES BY SIDEWALL MOUNTABLE ASSEMBLIES

(71) Applicant: PLASGAD PLASTIC PRODUCTS ACS LTD, Upper galilee (IL)

(72) Inventor: Iftah Poran, Ramat Ha Golan (IL)

(73) Assignee: Plasgad Plastic Products ACS Ltd, Kibbutz Gadot Northern District (IL)

( * ) Notice: Subject to any disclaimer, the term of this patent is extended or adjusted under 35 U.S.C. 154(b) by 47 days.

(21) Appl. No.: 17/940,784

(22) Filed: Sep. 8, 2022

(65) Prior Publication Data

US 2024/0083624 A1 Mar. 14, 2024

(51) Int. Cl.
*B65D 6/00* (2006.01)

(52) U.S. Cl.
CPC ..... *B65D 11/20* (2013.01); *B65D 11/10* (2013.01)

(58) Field of Classification Search
CPC ..... B65D 11/20; B65D 11/22; B65D 11/24; B65D 11/26; B65D 11/28; B65D 11/10; B65D 11/105; B65D 11/12; B65D 21/083; B65D 1/243; B65D 1/246; B65D 9/06; B65D 85/305; B65D 2501/24006; B65D 2501/24585; B65D 2501/24592; B65D 2501/24598; B65D 2501/24605; B65D 2501/24611; B65D 2501/24617
See application file for complete search history.

(56) References Cited

U.S. PATENT DOCUMENTS 4,723,679 A 2/1988 Sinchok et al.
5,720,403 A * 2/1998 Sawyer ..... B65D 9/06 217/65

(Continued)

FOREIGN PATENT DOCUMENTS

DE 202017002924 8/2018
EP 3566968 11/2019

(Continued)

OTHER PUBLICATIONS

European Search Report for European Application No. EP22194126.3 dated Mar. 10, 2023.

*Primary Examiner* — Kareen K Thomas
(74) *Attorney, Agent, or Firm* — Mark S. Cohen; PEARL COHEN ZEDEK LATZER BARATZ LLP

(57) ABSTRACT

A system for elevating polymeric crates with mounted sidewall assembly is described; a respective method of elevating polymeric crates with sidewall mountable assemblies and a kit-of-parts implementable for elevating polymeric crates with sidewall mountable assemblies are further described; the system comprises: a polymeric crate comprising a pair of longitudinal sidewalls and a pair of flanking sidewalls, at least one sidewall mountable elevating assembly comprising a pair of longitudinal members and a pair of flanking members; the method comprises: providing polymeric crate, providing pair of longitudinal members, providing pair of flanking members, mounting flanking members on polymeric crate, mounting longitudinal members on polymeric crate, assembling flanking members to longitudinal members; the kit-of-parts comprises: at least a pair of longitudinal members and at least a pair of flanking members.

6 Claims, 5 Drawing Sheets

(56) References Cited

U.S. PATENT DOCUMENTS

| | | | | |
|---|---|---|---|---|
| 7,556,166 | B2 | 7/2009 | Parnall et al. | |
| 7,886,926 | B2 | 2/2011 | Orgeldinger | |
| 8,109,402 | B2 * | 2/2012 | Hartwall | B65D 19/18 220/4.28 |
| 8,757,412 | B2 * | 6/2014 | Sommer | B65D 11/1833 220/4.28 |
| 2007/0029319 | A1 * | 2/2007 | Speck | B65D 11/26 220/6 |
| 2008/0110880 | A1 * | 5/2008 | Orgeldinger | B65D 21/083 220/4.03 |
| 2009/0134176 | A1 | 5/2009 | Yamauchi | |
| 2009/0184113 | A1 * | 7/2009 | Smith, III | B65D 7/44 29/700 |
| 2011/0240637 | A1 * | 10/2011 | Orgeldinger | B65D 85/34 220/601 |
| 2015/0034636 | A1 * | 2/2015 | Aaland | B65D 25/10 220/660 |
| 2015/0225114 | A1 * | 8/2015 | Sirowatka | B65D 9/18 217/13 |
| 2019/0092518 | A1 * | 3/2019 | Sugar | B65D 9/06 |
| 2020/0140145 | A1 | 5/2020 | Huizingh | |

FOREIGN PATENT DOCUMENTS

| | | | |
|---|---|---|---|
| EP | 3795490 | | 3/2021 |
| JP | 2014156286 | A | 8/2014 |
| JP | 6154499 | B1 | 7/2017 |

* cited by examiner

SYSTEMS METHODS AND RESPECTIVE KIT-OF-PARTS FOR ELEVATING POLYMERIC CRATES BY SIDEWALL MOUNTABLE ASSEMBLIES

TECHNICAL FIELD

In general, the present invention pertains to the art of manufacturing polymeric crates and accessories therefor. In particular, the invention relates to systems and methods for assembling polymeric crates with elevated sidewalls.

BACKGROUND ART

It is believed that the current state of the art is represented by the following patent literature: U.S. Pat. Nos. 7,556,166, 7,886,926, US2009134176, US2020140145, EP3566968, EP3795490, DE202017002924.

DE202017002924 that is believed to represent the closest prior art discloses a folding box frame element for increasing the volume of a folding box, with a wall element, a plurality of connecting elements connected to the wall element for connecting the wall element to a sidewall of the folding box. In DE202017002924, at least two connecting elements have a latching element, which in the assembled state cooperates with a recess and/or a shoulder of the sidewall.

U.S. Pat. No. 7,886,926 that is believed to represent relevant prior art discloses a transport container system including a stackable crate having a bottom element and four sidewall elements which are of a dimensionally and pressure stable structure. Each of the sidewall elements has a foldable attachment element connected to it. In U.S. Pat. No. 7,886,926, when folded up, the attachment elements of the four side wall elements form an attachment which increases the volumetric capacity of the crates. The attachment elements in U.S. Pat. No. 7,886,926 are born on an upper side of the respective sidewall element and be retained in the folded-up position by guides provided on the sidewall elements. In U.S. Pat. No. 7,886,926, when folded down, the respective attachment elements can be integrated into the respective sidewall element in such a manner that the attachment elements at least will not protrude substantially over the thickness of the sidewall elements.

SUMMARY OF THE INVENTION

The following summary of the invention is provided in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

The invention was made in view of the deficiencies of the prior art and provides systems, methods and processes for overcoming these deficiencies. According to some embodiments and aspects of the present invention, there is provided a system for elevating polymeric crates with mounted sidewall assembly, including: a polymeric crate including: a pair of longitudinal sidewalls, in which each one of the longitudinal sidewalls including at least one vertically oriented aperture on a top face thereof; a pair of flanking sidewalls, in which each one of the flanking sidewalls including at least one vertically oriented aperture on a top face thereof; at least one sidewall mountable elevating assembly, including: a pair of longitudinal members, in which each one of the longitudinal members including: an essentially elongated rectangular shape; at least one fastener on a bottom face of the elongated essentially rectangular shape; in which the at least one fastener is configured to be vertically insertable into the at least one vertically oriented aperture on the top face of the longitudinal sidewalls; a pair of terminal portions, in which each one of the terminal portions including at least one laterally connecting element; a pair of flanking members, in which each one of the flanking members including: an essentially elongated rectangular shape; at least one fastener on a bottom face of the elongated essentially rectangular shape; in which the at least one fastener is configured to be vertically insertable into the at least one vertically oriented aperture on the top face of the flanking sidewalls; a pair of terminal portions, in which each one of the terminal portions including at least one laterally connecting element; in which the laterally connecting elements on the terminal portions of the flanking members, in an assembled state, are interlocked with the laterally connecting elements of the terminal portions of the longitudinal members.

In some embodiments, the fasteners of the longitudinal members or the flanking members of the at least one sidewall mountable elevating assembly are of a first type, in which the fasteners of the first type are insertable and securable within the vertically oriented aperture of the longitudinal or the flanking sidewalls of the polymeric crate by a vertical downward movement.

In some embodiments, the fasteners of the longitudinal members or the flanking members of the at least one sidewall mountable elevating assembly are of a second type, in which the fasteners of the second type are insertable into the vertically oriented aperture of the longitudinal sidewalls or the flanking sidewalls of the polymeric crate by a vertical downward movement and securable within the flanking sidewalls of the polymeric crate by a lateral sidewise movement.

In some embodiments, the fasteners of the second type are selected from the group consisting of: snap fastener, clip fastener, frictional joining, expanding rivets, crimps.

In some embodiments, the at least one sidewall mountable elevating assembly includes at least a first sidewall mountable elevating assembly and a second sidewall mountable elevating assembly, in which the longitudinal members and the flanking members further including at least one vertically oriented aperture on a top face thereof, in which the fasteners of the first sidewall mountable elevating assembly are insertable and securable within the vertically oriented apertures on the top face of the longitudinal members and the flanking members of the second sidewall mountable elevating assembly.

In some embodiments, the laterally connecting elements of the terminal portions of the longitudinal members are interlocked with the laterally connecting elements on the terminal portions of the flanking members by vertically inserting the laterally connecting elements of the terminal portions of the longitudinal members into the laterally connecting elements on the terminal portions of the flanking members.

According to some embodiments and aspects of the present invention, there is provided a method of assembling polymeric crates with mounted sidewall elevating members, including the steps of: providing a polymeric crate including: a pair of longitudinal sidewalls, in which each one of the longitudinal sidewalls including at least one vertically oriented aperture on a top face thereof; a pair of flanking sidewalls, in which each one of the flanking sidewalls including at least one vertically oriented aperture on a top face thereof; providing a pair of longitudinal members, in which each one of the longitudinal members including: an essentially elongated rectangular shape; at least one fastener on a bottom face of the elongated essentially rectangular shape; in which the at least one fastener is configured to be vertically insertable into the at least one vertically oriented aperture on the top face of the longitudinal sidewalls; a pair of terminal portions, in which each one of the terminal portions including at least one laterally connecting element; providing a pair of flanking members, in which each one of the flanking members including: an essentially elongated rectangular shape; at least one fastener on a bottom face of the elongated essentially rectangular shape; in which the at least one fastener is configured to be vertically insertable into the at least one vertically oriented aperture on the top face of the flanking sidewalls; a pair of terminal portions, in which each one of the terminal portions including at least one laterally connecting element; in which the laterally connecting elements on the terminal portions of the flanking members, in an assembled state, are interlocked with the laterally connecting elements of the terminal portions of the longitudinal members; mounting the pair of flanking members on the top face of pair of flanking sidewalls of the polymeric crate; mounting the pair of longitudinal members on the top face of pair of longitudinal sidewalls of the polymeric crate; assembling by interconnecting the pair of terminal portions of the pair of flanking members to the pair of terminal portions of the pair of longitudinal members.

In some embodiments, the step of assembling the pair of flanking members and the longitudinal members precedes the steps of mounting the flanking members the longitudinal members on the top face of the flanking sidewalls of the polymeric crate.

According to some embodiments and aspects of the present invention, there is provided a kit-of-parts implementable for assembling polymeric crates with mounted sidewall elevating members including: at least a pair of longitudinal members, in which each one of the longitudinal members including: an essentially elongated rectangular shape; at least one fastener on a bottom face of the elongated essentially rectangular shape; in which the at least one fastener is configured to be vertically insertable into at least one vertically oriented aperture on a top face of longitudinal sidewalls of a polymeric crate; a pair of terminal portions, in which each one of the terminal portions including at least one laterally connecting element; at least a pair of flanking members, in which each one of the flanking members including: an essentially elongated rectangular shape; at least one fastener on a bottom face of the elongated essentially rectangular shape; in which the at least one fastener is configured to be vertically insertable into at least one vertically oriented aperture on a top face of flanking sidewalls of a polymeric crate; a pair of terminal portions, in which each one of the terminal portions including at least one laterally connecting element; in which the laterally connecting elements on the terminal portions of the flanking members, in an assembled state, are interlockable with the laterally connecting elements of the terminal portions of the longitudinal members.

Definitions

The term matching or a term similar thereto as referred to herein is to be construed as having a cross-sectional area and/or shape of a component equal or essentially similar to a cross-sectional area and/or shape of another component. It should be acknowledged that the components may only to be similar in the cross-sectional areas and/or shapes, to satisfy the term matching or similar, so long as the cross-sectional areas of the components can be mated and/or inserted into each other and/or the combination thereof essentially fits together and/or occupy essentially the same space.

The term structured as referred to herein is to be construed as including any geometrical shape, exceeding in complexity a plain linear shape or a shape embodying simple cylindrical, elliptical or polygonal contour or profile. A more complex shape, a plain linear shape or a shape embodying simple cylindrical, elliptical or polygonal contour or profile, constitutes an example of structured geometry.

The term modular, as referred to herein, should be construed as a stand-alone unit. The term modular inter alia means a standardized unit that may be conveniently installed or deployed without significant impact to the environment. The term modular, however, doesn't necessarily mean providing for ease of interchange or replacement. The term modular is optionally satisfied by providing for ease of at least onetime deployment or installation.

The term readily connectable, as referred to herein, should be construed as a standardized unit that may be conveniently connected to other components of the system. The term readily connectable, however, doesn't necessarily mean readily disconnectable or removable. The term readily connectable is optionally satisfied by providing for ease of at least onetime connection or coupling.

By operationally connected and operably coupled or similar terms used herein is meant connected in a specific way (e.g., in a manner allowing fluid to move and/or electric power to be transmitted) that allows the disclosed system and its various components to operate effectively in the manner described herein.

In the specification or claims herein, any term signifying an action or operation, such as: a verb, whether in base form or any tense, gerund or present/past participle, is not to be construed as necessarily to be actually performed but rather in a constructive manner, namely as to be performed merely optionally or potentially.

The term substantially as used herein is a broad term, and is to be given its ordinary and customary meaning to a person of ordinary skill in the art (and is not to be limited to a special or customized meaning), and refers without limitation to being largely but not necessarily entirely of that quantity or quality which is specified.

The term essentially means that the composition, method or structure may include additional ingredients, stages and or parts, but only if the additional ingredients, the stages and/or the parts do not materially alter the basic and new characteristics of the composition, method or structure claimed.

As used herein, the term or is an inclusive or operator, equivalent to the term and/or, unless the context clearly dictates otherwise; whereas the term and as used herein is also the alternative operator equivalent to the term and/or, unless the context clearly dictates otherwise.

It should be understood, however, that neither the briefly synopsized summary nor particular definitions hereinabove are not to limit interpretation of the invention to the specific forms and examples but rather on the contrary are to cover all modifications, equivalents and alternatives falling within the scope of the invention.

DESCRIPTION OF THE DRAWINGS

The present invention will be understood and appreciated more comprehensively from the following detailed description taken in conjunction with the appended drawings in which.

Figure 1:
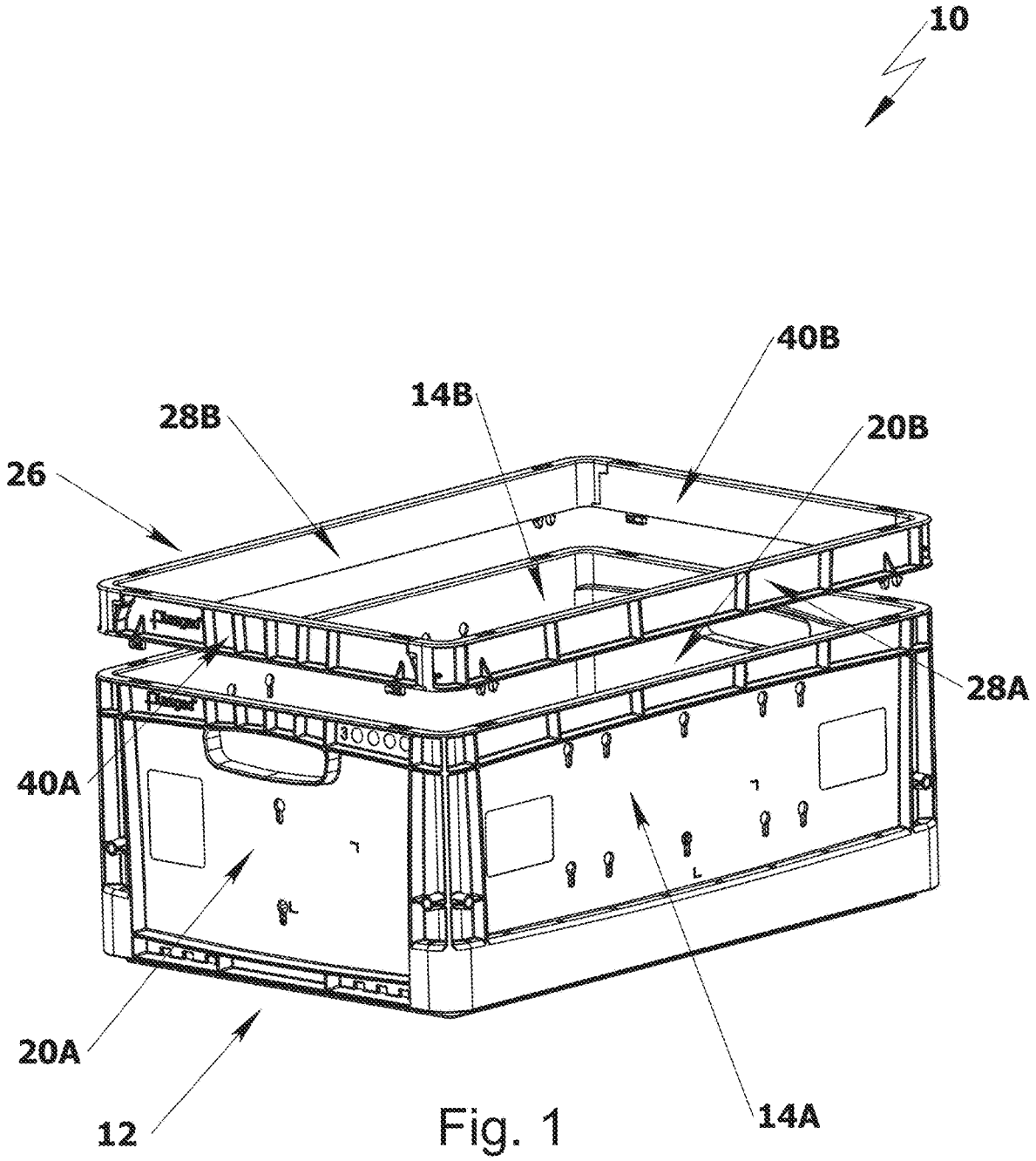
FIG. 1 is a perspective view of a polymeric crate with sidewall mountable elevating assembly, according to some embodiments of the present invention.
Figure 2A:
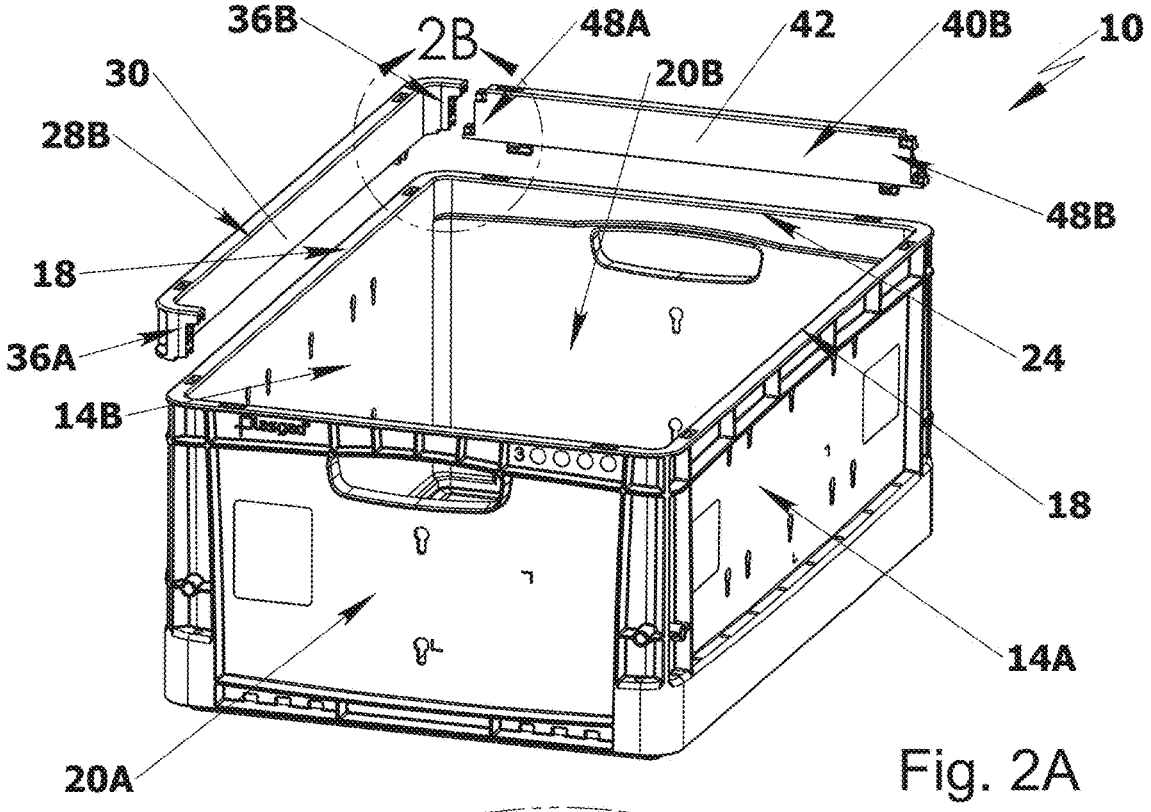
FIG. 2A is a perspective view of a polymeric crate with longitudinal and flanking members of a sidewall mountable elevating assembly, according to some embodiments of the present invention.
Figure 2B:
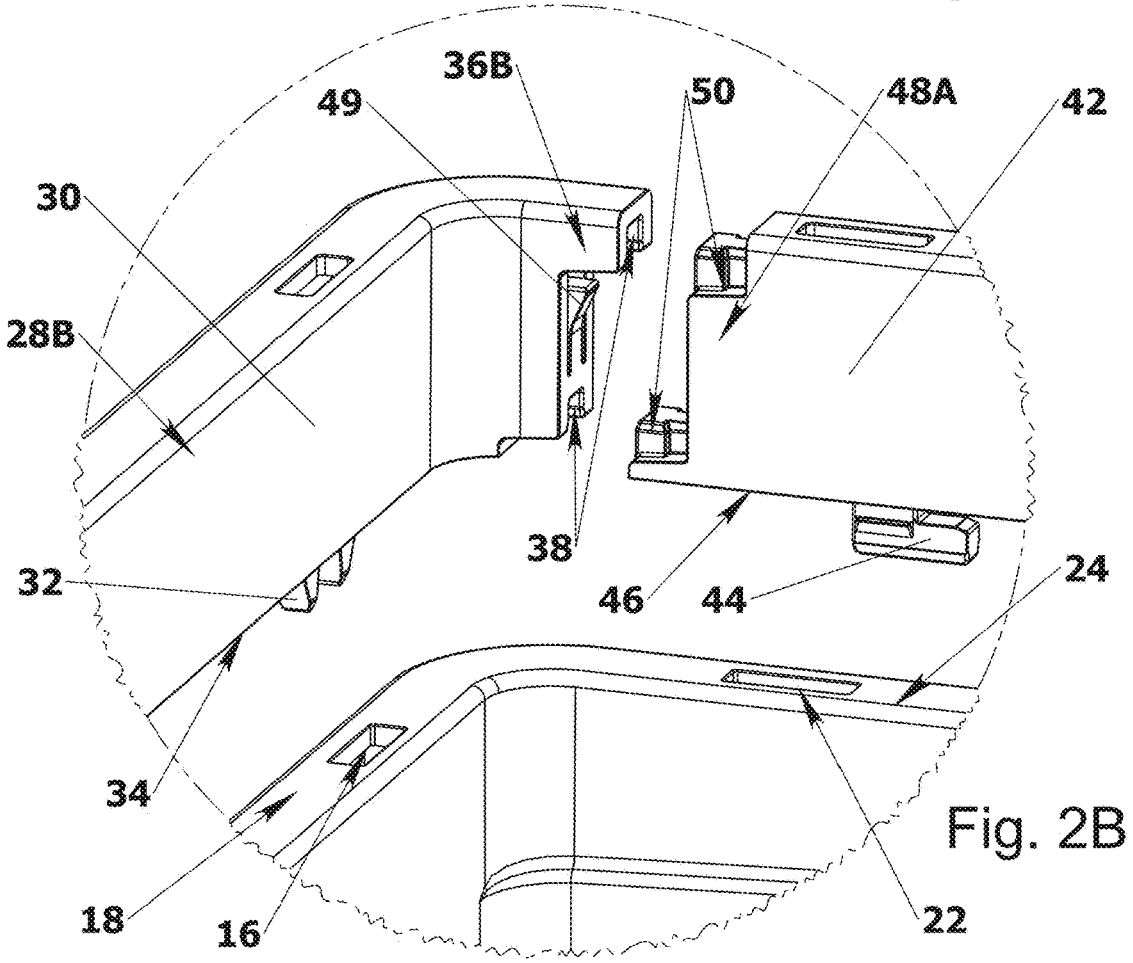
FIG. 2B is an enlarged view of the polymeric crate with longitudinal and flanking members of a sidewall mountable elevating assembly, according to some embodiments of the present invention.
Figure 3A:
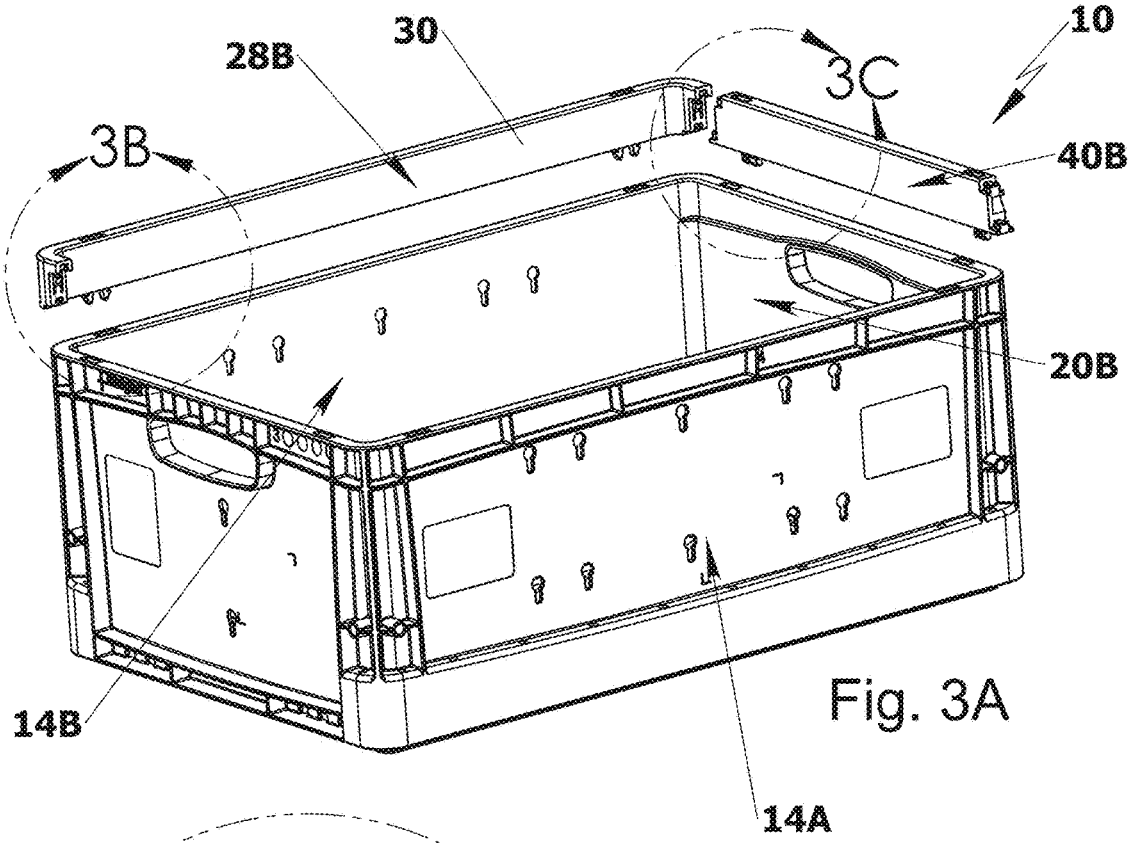
FIG. 3A is a perspective view of a polymeric crate with longitudinal and flanking members of a sidewall mountable elevating assembly, according to another embodiment of the present invention.
Figure 3B:
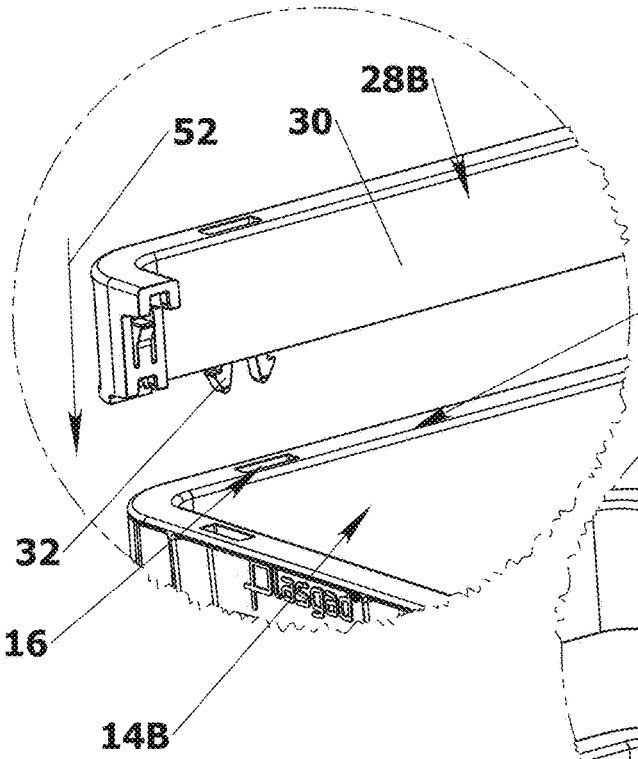
FIG. 3B is an enlarged view of the longitudinal member of a sidewall mountable elevating assembly mounted onto a longitudinal sidewall of the polymeric crate, according to another embodiment of the present invention.
Figure 3C:
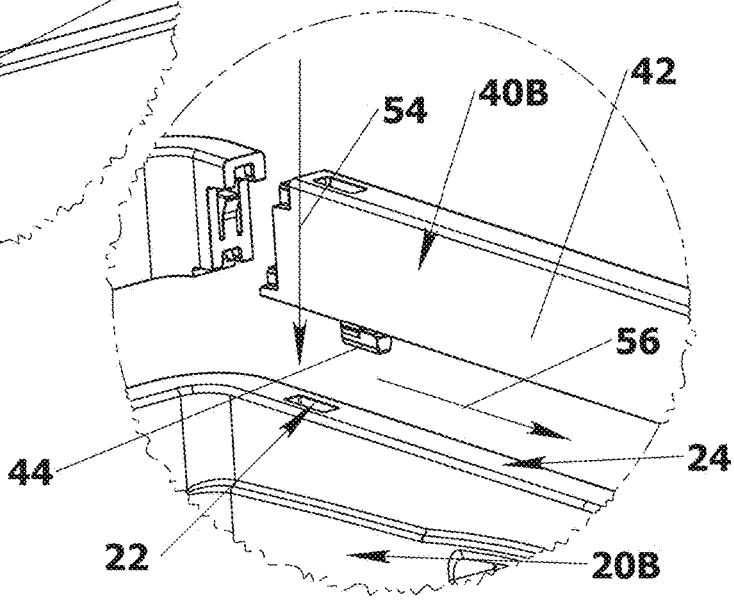
FIG. 3C is an enlarged view of the flanking member of a sidewall mountable elevating assembly mounted onto a flanking sidewall of the polymeric crate, according to another embodiment of the present invention.
Figure 4A:
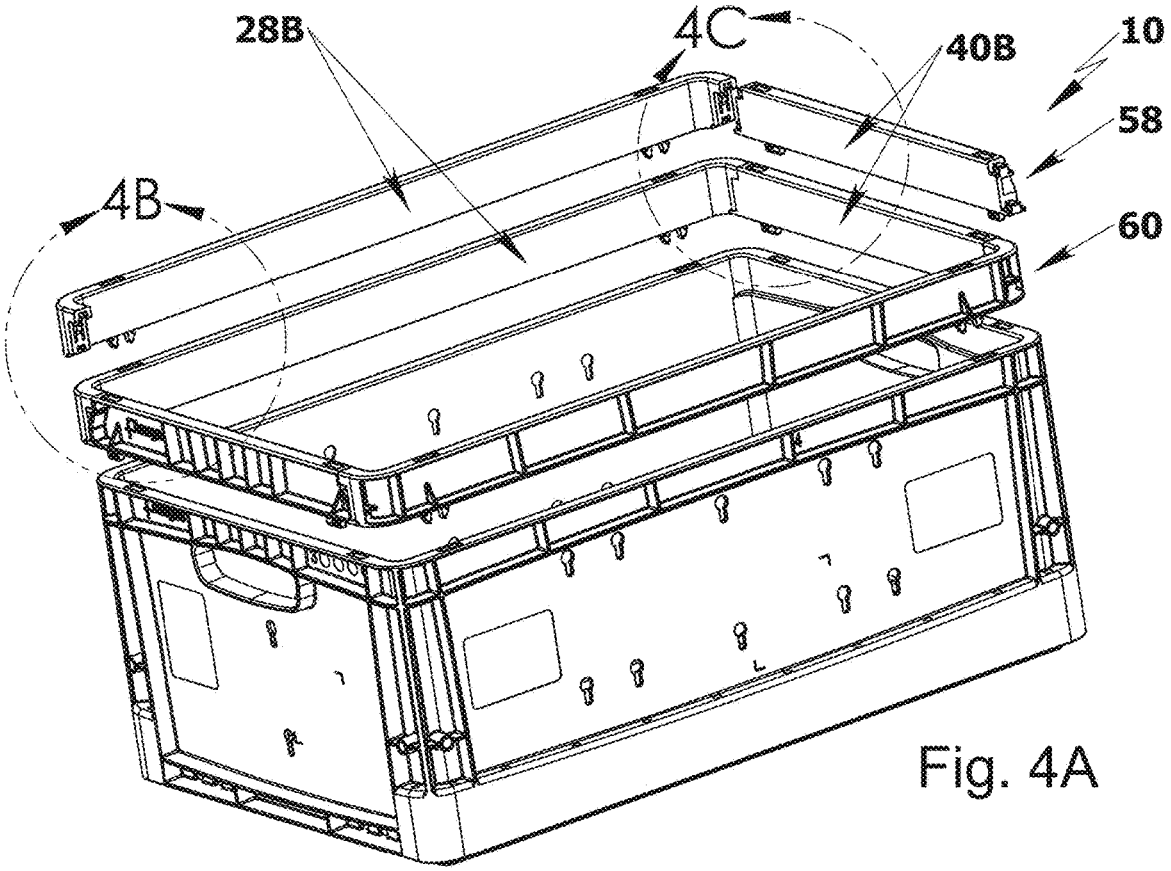
FIG. 4A is a perspective view of a polymeric crate with a first sidewall mountable elevating assembly and longitudinal and flanking members of a second sidewall mountable elevating assembly, mounted in tandem on top of the first sidewall mountable elevating assembly, according to some embodiments of the present invention.
Figure 4B:
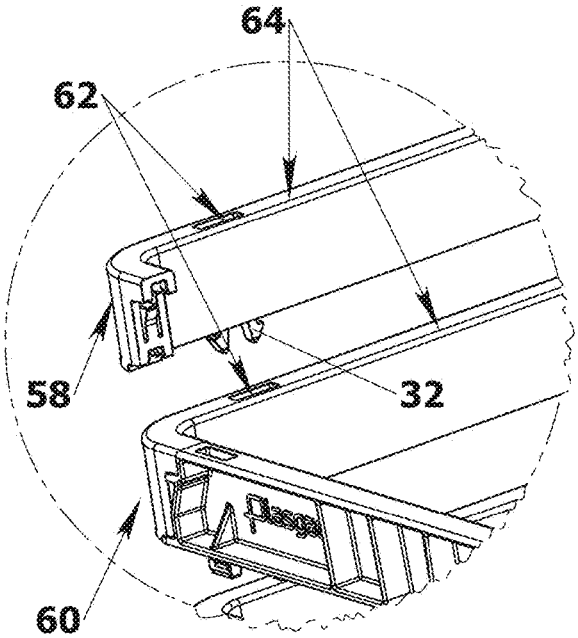
FIG. 4B is an enlarged view of a longitudinal member of a second sidewall mountable elevating assembly mounted in tandem on top of the first sidewall mountable elevating assembly, according to some embodiments of the present invention.
Figure 4C:
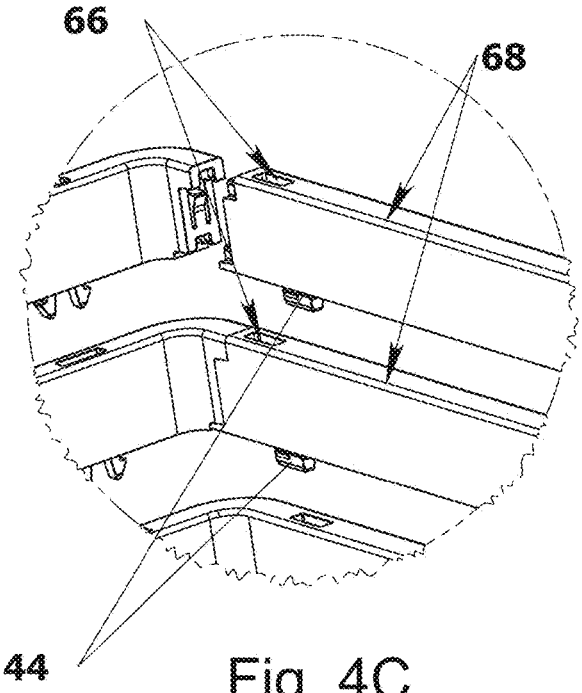
FIG. 4C is an enlarged view of a flanking member of a second sidewall mountable elevating assembly mounted in tandem on top of the first sidewall mountable elevating assembly, according to some embodiments of the present invention.

While the invention is susceptible to various modifications and alternative forms, specific embodiments thereof have been shown merely by way of example in the drawings. The drawings are not necessarily complete and components are not essentially to scale; emphasis instead being placed upon clearly illustrating the principles underlying the present invention.

DETAILED DISCLOSURE OF EMBODIMENTS

Illustrative embodiments of the invention are described below. In the interest of clarity, not all features of actual implementation are described in this specification. It should be appreciated that various features or elements described in the context of some embodiment may be interchangeable with features or elements of any other embodiment described in the specification. Moreover, it will be appreciated that for the development of any actual embodiment, numerous implementation-specific decisions must be made to achieve the developers' specific goals, such as compliance with technology- or business-related constraints, which may vary from one implementation to another, and the effort of such a development might be complex and time-consuming, but would nevertheless be a routine undertaking for those of ordinary skill in the art having the benefit of this disclosure.

In accordance with some embodiments of the present invention, reference is now made to FIGS. 1 to 4C, showing system 10 for elevating polymeric crates with mounted sidewall assembly. In some embodiments, system 10 comprises polymeric crate 12. In some embodiments, polymeric crate 12 comprises a pair of longitudinal sidewalls 14A and 14B. Each one of longitudinal sidewalls 14A and 14B comprises at least one vertically oriented aperture 16 on top face 18 thereof. In some embodiments, polymeric crate 12 further comprises a pair of flanking sidewalls 20A and 20B. Each one of flanking sidewalls 20A and 20B comprises at least one vertically oriented aperture 22 on top face 24 thereof. In some embodiments, longitudinal sidewalls 14A and 14B and/or flanking sidewalls 20A and 20B of polymeric crate 12 are foldable, for instance by forming a hinge and other pivoting connection with the base platform of polymeric crate 12; whereas in other embodiments, polymeric crate 12 is monolithic and longitudinal sidewalls 14A and 14B and/or flanking sidewalls 20A and 20B of are permanently affixed to the base platform of polymeric crate 12.

In some embodiments, system 10 for elevating polymeric crates with mounted sidewall assembly further comprises at least one sidewall mountable elevating assembly 26. In some embodiments, at least one sidewall mountable elevating assembly 26 comprises a pair of longitudinal members 28A and 28B. In some embodiments, each one of longitudinal members 28A and 28B comprises essentially elongated rectangular shape 30.

In some embodiments, each one of longitudinal members 28A and 28B further comprises at least one fastener 32. At least one fastener 32 is disposed on bottom face 34 of essentially elongated rectangular shape 30 of each one of longitudinal members 28A and 28B. In some embodiments, at least one fastener 32 is configured to be vertically insertable into at least one vertically oriented aperture 16 on top face 18 of longitudinal sidewalls 14A and 14B of polymetric crate 12.

In some embodiments, each one of longitudinal members 28A and 28B further comprises pair of terminal portions 36A and 36B. In some embodiments, each one of terminal portions 36A and 36B comprises at least one laterally connecting element 38.

In some embodiments, at least one sidewall mountable elevating assembly 26 comprises a pair of flanking members 40A and 40B. In some embodiments, each one of flanking members 40A and 40B comprises essentially elongated rectangular shape 42.

In some embodiments, each one of flanking members 40A and 40B further comprises at least one fastener 44. At least one fastener 44 is disposed on bottom face 46 of essentially elongated rectangular shape 42. In some embodiments, at least one fastener 44 is configured to be vertically insertable into at least one vertically oriented aperture 22 on top face 24 of flanking sidewalls 20A and 20B of polymetric crate 12.

In some embodiments, each one of flanking members 40A and 40B further comprises a pair of terminal portions 48A and 48B. In some embodiments, each one of terminal portions 48A and 48B comprises at least one laterally connecting element 50. In some embodiments, at least one laterally connecting element 50 of terminal portions 48A and 48B of each one of flanking members 40A and 40B, in an assembled state, is interlocked with at least one laterally connecting element 38 of terminal portions 36A and 36B of each one of longitudinal members 28A and 28B.

In some embodiments, the interlocking of at least one laterally connecting element 38 of terminal portions 36A and 36B of each one of longitudinal members 28A and 28B with at least one laterally connecting element 50 of terminal portions 48A and 48B of each one of flanking members 40A and 40B is achieved by vertically inserting laterally connecting element 38 of terminal portions 36A and 36B of each one of longitudinal members 28A and 28B into laterally connecting element 50 of terminal portions 48A and 48B of each one of flanking members 40A and 40B.

In some embodiments, terminal portions 36A and 36B of each one of longitudinal members 28A and 28B further comprises laterally fastening element 49, whereas terminal portions 48A and 48B of each one of flanking members 40A and 40B further comprise a respective receiving recess. Laterally fastening element 49 of terminal portions 36A and 36B of longitudinal members 28A and 28B is disposed within the receiving recess of terminal portions 48A and 48B of flanking members 40A and 40B, thereby securing longitudinal members 28A and 28B to flanking members 40A and 40B.

In some embodiments, at least one fastener 32 of longitudinal members 28A and 28B of at least one sidewall mountable elevating assembly 26 is of a first type. In some embodiments, at least one fastener 32 of the first type is inserted vertically and downwardly in the direction of arrow 52 and eventually secured within at least one vertically oriented aperture 16 of longitudinal sidewalls 14A and 14B of polymetric crate 12. In some examples, at least one fastener 32 of the first type is a snap fastener, clip fastener, frictional joining, expanding rivets, crimps.

In some embodiments, each one of flanking members 40A and 40B further comprises at least one fastener 44. At least one fastener 44 is disposed on bottom face 46 of essentially elongated rectangular shape 42. In some embodiments, at least one fastener 44 is configured to be vertically insertable into at least one vertically oriented aperture 22 on top face 24 of flanking sidewalls 20A and 20B of polymetric crate 12.

In some embodiments, at least one fastener 44 of flanking members 40A and 40B of at least one sidewall mountable elevating assembly 26 is of a second type. In some embodiments, at least one fastener 44 of the second type is vertically insertable in the direction of arrow 54 downwardly into vertically oriented aperture 22 of flanking sidewalls 20A and 20B, thereby mounting flanking members 40A and 40B onto flanking sidewalls 20A and 20B of polymetric crate 12. In some embodiments, at least one fastener 44 of the second type is securable by a laterally sidewise movement in the direction of arrow 56 within flanking sidewalls 20A and 20B, thereby securing and/or affixing flanking members 40A and 40B to flanking sidewalls 20A and 20B of polymetric crate 12.

In some embodiments, system 10 for elevating polymeric crates with mounted sidewall assembly further comprises first sidewall mountable elevating assembly 58 and second sidewall mountable elevating assembly 60. In some embodiments, first sidewall mountable elevating assembly 58 is mounted in tandem on top of second sidewall mountable elevating assembly 60. In some embodiments, longitudinal members 28A and 28B further comprise at least one vertically oriented aperture 62 on top face 64 thereof.

In some embodiments, at least one fastener 32 of longitudinal member 28B of first sidewall mountable elevating assembly 58 is inserted and secured within vertically oriented aperture 62 on top face 64 of longitudinal member 28B of second sidewall mountable elevating assembly 60. In some embodiments, at least one fastener 44 of first sidewall mountable elevating assembly 58 is inserted and secured within vertically oriented aperture 66 on top face 68 of flanking members 40B of second sidewall mountable elevating assembly 60.

Figure 5:
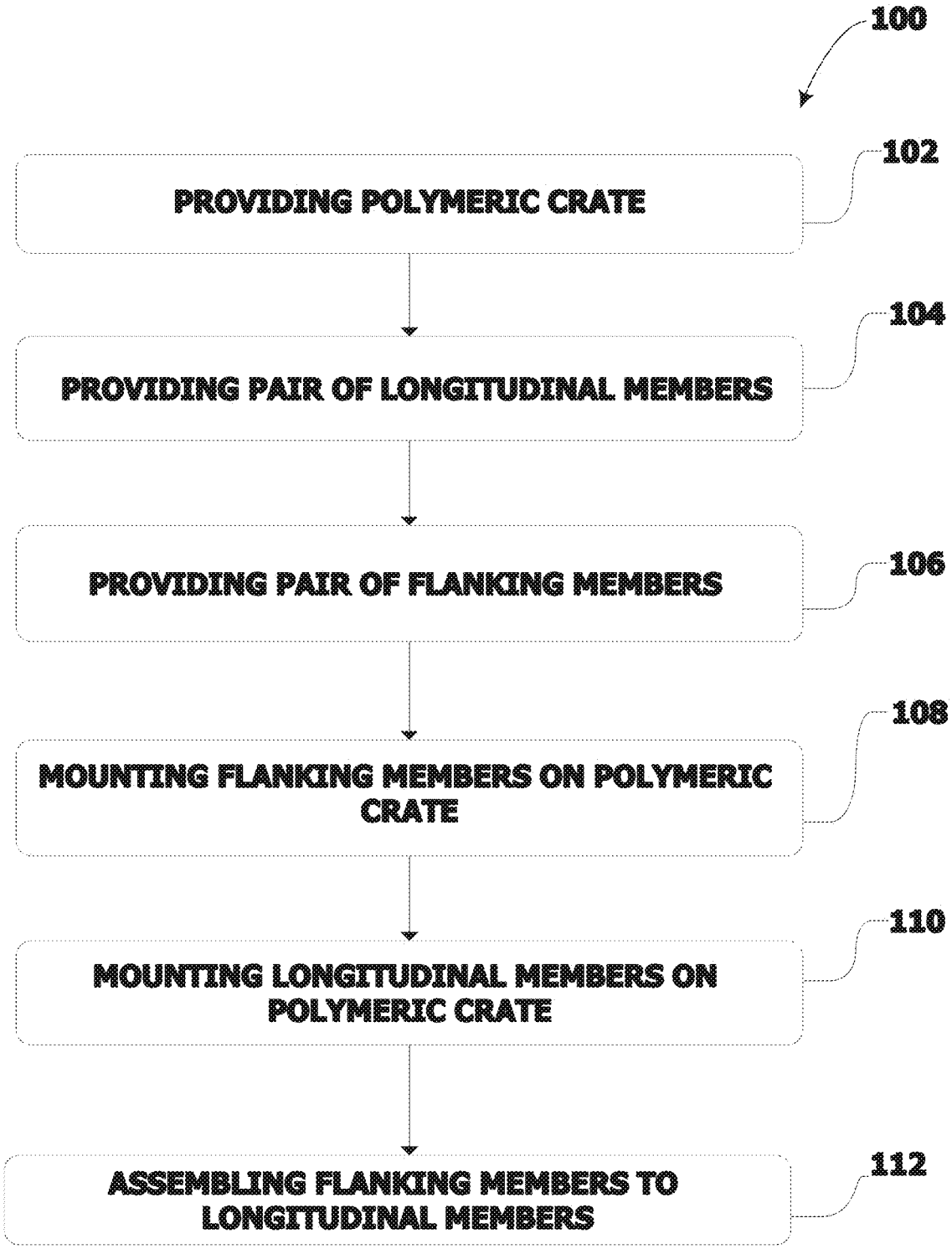
FIG. 5 is a flowchart of the method of assembling polymeric crates with mounted sidewall elevating assembly, according to some embodiments of the present invention.

In accordance with some embodiments of the present invention, reference is now made FIG. 5 showing flowchart of method 100 of elevating polymeric crates with sidewall mountable assembly. The method of the embodiment of FIG. 5 illustrates various features that may be interchangeable with elements of any other embodiment described in the specification.

In some embodiments, method 100 commences with step 102 of providing a polymeric crate. In some embodiments, the polymeric crate comprises a pair of longitudinal sidewalls, in which each one of the longitudinal sidewalls comprising at least one vertically oriented aperture on a top face thereof. In some embodiments, the polymeric crate further comprises a pair of flanking sidewalls, in which each one of the flanking sidewalls comprising at least one vertically oriented aperture on a top face thereof.

In some embodiments, method 100 further proceeds to step 104 of providing a pair of longitudinal members. In some embodiments, each one of the longitudinal members comprises an essentially elongated rectangular shape and at least one fastener on a bottom face of the elongated essentially rectangular shape. In some embodiments, the at least one fastener is configured to be vertically insertable into the at least one vertically oriented aperture on the top face of the longitudinal sidewalls. In some embodiments, the longitudinal members comprise a pair of terminal portions, in which each one of the terminal portions comprising at least one laterally connecting element.

In some embodiments, method 100 further includes step 106 of providing a pair of flanking members. In some embodiments, each one of the flanking members comprises an essentially elongated rectangular shape and at least one fastener on a bottom face of the elongated essentially rectangular shape. In some embodiments, the at least one fastener is configured to be vertically insertable into the at least one vertically oriented aperture on the top face of the flanking sidewalls.

In some embodiments, the flanking members further comprise a pair of terminal portions, in which each one of the terminal portions comprising at least one laterally connecting element. In some embodiments, the laterally connecting elements on the terminal portions of the flanking members, in an assembled state, are interlocked with the laterally connecting elements of the terminal portions of the longitudinal members. In some embodiments, the terminal portions of the longitudinal members are interlocked with the laterally connecting elements of the terminal portions of the flanking members, for instance by vertically inserting the laterally connecting elements of the terminal portions of the longitudinal members into the laterally connecting elements on the terminal portions of the flanking members.

In some embodiments, method 100 further proceeds to step 108 of mounting the pair of flanking members on the top face of pair of flanking sidewalls of the polymeric crate. In some examples, step 108 of mounting the pair of flanking members on the top face of pair of flanking sidewalls of the polymeric crate includes a first sub-step of pre-mounting the flanking member on the top face of pair of flanking sidewall, by vertically inserting the fasteners of the flanking member into the apertures of flanking sidewalls of the polymeric crate. In some examples, step 108 of mounting the pair of flanking members on the top face of pair of flanking sidewalls of the polymeric crate includes a second sub-step of securing and/or affixing the flanking member to the flanking sidewall, by laterally moving the fasteners of the flanking member in a sidewise direction within the apertures of flanking sidewalls of the polymeric crate.

In some embodiments, method 100 yet further includes step 110 of mounting the pair of longitudinal members on the top face of pair of longitudinal sidewalls of the polymeric crate. In some embodiments, method 100 still further includes step 112 of assembling by interconnecting the pair of terminal portions of the pair of flanking members to the pair of terminal portions of the pair of longitudinal members.

In some embodiments, step 112 of assembling the pair of flanking members and the longitudinal members precedes the step 108 of mounting the pair of flanking members on the top face of pair of flanking sidewalls of the polymeric crate. In other embodiments, step 112 of assembling the pair of flanking members and the longitudinal members precedes the step 110 of mounting the pair of longitudinal members on the top face of pair of longitudinal sidewalls of the polymeric crate.

In some embodiments, method 100 of elevating polymeric crates with sidewall mountable assembly further comprises dismantling the sidewall mountable assembly from the polymeric crate. In such embodiments, where the fasteners of the longitudinal members of the sidewall mountable assembly as well as the fasteners of the flanking members of the sidewall mountable assembly are of the first type, the dismantling of the sidewall mountable assembly comprises releasing the fasteners of the longitudinal members and/or the flanking members, regardless the order, and then removing the longitudinal members and/or the flanking members by drawing the longitudinal members and/or the flanking members upwards. However, in such embodiments, where the fasteners of the longitudinal members of the sidewall mountable assembly are of the first type, whereas the fasteners of the flanking members of the sidewall mountable assembly are of the second type, the dismantling of the sidewall mountable assembly comprises firstly releasing the fasteners of the longitudinal members and then removing the longitudinal members by drawing the longitudinal members upwards, and only subsequently to that releasing the fasteners of the flanking members, by displacing the flanking members sidewise, and then removing the flanking members by drawing the flanking members upwards.

INDEX OF REFERENCE NUMERALS

Within the specification hereinabove inter alia the following numerals were used to denote the particular constituents in the appended drawings:

10—system for elevating polymeric crates
12—polymeric crate
14A and 14B—longitudinal sidewalls
16—vertically oriented aperture of longitudinal sidewalls
18—top face of longitudinal sidewalls
20A and 20B—flanking sidewalls
22—vertically oriented aperture of flanking sidewalls
24—top face of flanking sidewalls
26—sidewall mountable elevating assembly
28A and 28B—longitudinal members
30—elongated rectangular shape of longitudinal members
32—fastener of longitudinal members
34—bottom face of longitudinal members
36A and 36B—terminal portions of longitudinal members
38—laterally connecting element of longitudinal members
40A and 40B—flanking members
42—elongated rectangular shape of flanking members
44—fastener of flanking members
46—bottom face of flanking members
48A and 48B—terminal portions of flanking members
50—connecting element of flanking members
52—directional arrow for assembling longitudinal members
54—directional arrow for mounting flanking members
54—directional arrow for securing flanking members
58—first sidewall mountable elevating assembly
60—second sidewall mountable elevating assembly
62—vertically oriented aperture of longitudinal members
64—top face of longitudinal members
66—vertically oriented aperture of flanking members
68—top face of flanking members
100—method of elevating polymeric crates
102—providing a polymeric crate
104—providing longitudinal members
106—providing flanking members
108—mounting flanking members
110—mounting longitudinal members
112—assembling by interconnecting It will be appreciated by persons skilled in the art of the invention that various features and/or elements elaborated in the context of a specific embodiment described hereinabove and/or referenced herein and/or illustrated by a particular example in a certain drawing enclosed hereto, whether method, system, device or product, is/are interchangeable with features and/or elements of any other embodiment described in the specification and/or shown in the drawings.

Moreover, skilled persons would appreciate that the present invention is not limited by what has been particularly shown and described hereinabove. Rather the scope of the invention is defined by the claims which follow:

The invention claimed is:

1. A system for elevating polymeric crates with mounted sidewall assembly, comprises:

(a) a polymeric crate comprising:
  (I) a pair of longitudinal sidewalls, wherein each one of said longitudinal sidewalls comprising at least one vertically oriented aperture on a top face thereof;
  (II) a pair of flanking sidewalls, wherein each one of said flanking sidewalls comprising at least one vertically oriented aperture on a top face thereof;

(b) at least one sidewall mountable elevating assembly, comprising:
  (I) a pair of longitudinal members, wherein each one of said longitudinal members comprising:
    (i) an essentially elongated rectangular shape;
    (ii) at least one fastener on a bottom face of said elongated essentially rectangular shape;
      wherein said at least one fastener is configured to be vertically insertable into said at least one vertically oriented aperture on said top face of said longitudinal sidewalls;
    (iii) a pair of terminal portions, wherein each one of said terminal portions comprising at least one laterally connecting element;
  (II) a pair of flanking members, wherein each one of said flanking members comprising:
    (i) an essentially elongated rectangular shape;

(ii) at least one fastener on a bottom face of said elongated essentially rectangular shape;

wherein said at least one fastener is configured to be vertically insertable into said at least one vertically oriented aperture on said top face of said flanking sidewalls;

(iii) a pair of terminal portions, wherein each one of said terminal portions comprising at least one laterally connecting element;

wherein said laterally connecting elements on said terminal portions of said flanking members, in an assembled state, are interlocked with said laterally connecting elements of said terminal portions of said longitudinal members.

2. The system as in claim 1, wherein said fasteners of said longitudinal members or said flanking members of said at least one sidewall mountable elevating assembly are of a first type, wherein said fasteners of said first type are insertable and securable within said vertically oriented aperture of said longitudinal or said flanking sidewalls of said polymeric crate by a vertical downward movement.

3. The system as in claim 1, wherein said fasteners of said longitudinal members or said flanking members of said at least one sidewall mountable elevating assembly are of a second type, wherein said fasteners of said second type are insertable into said vertically oriented aperture of said longitudinal sidewalls or said flanking sidewalls of said polymeric crate by a vertical downward movement and securable within said flanking sidewalls of said polymeric crate by a lateral sidewise movement.

4. The system as in claim 1, wherein said fasteners of said second type are selected from the group consisting of: snap fastener, clip fastener, frictional joining, expanding rivets, crimps.

5. The system as in claim 1, wherein said at least one sidewall mountable elevating assembly comprises at least a first sidewall mountable elevating assembly and a second sidewall mountable elevating assembly, wherein said longitudinal members and said flanking members further comprising at least one vertically oriented aperture on a top face thereof, wherein said fasteners of said first sidewall mountable elevating assembly are insertable and securable within said vertically oriented apertures on said top face of said longitudinal members and said flanking members of said second sidewall mountable elevating assembly.

6. The system as in claim 1, wherein said laterally connecting elements of said terminal portions of said longitudinal members are interlocked with said laterally connecting elements on said terminal portions of said flanking members by vertically inserting said laterally connecting elements of said terminal portions of said longitudinal members into said laterally connecting elements on said terminal portions of said flanking members.

* * * * *